US005241715A

United States Patent [19]

Duvall et al.

[11] Patent Number: 5,241,715

[45] Date of Patent: Sep. 7, 1993

[54] SHAMPOO BOX FOR SHOWER ENCLOSURE

[76] Inventors: William K. Duvall, 24711 Via Princesa, Lake Forest, Calif. 92630; David A. Rieman, 3901 Calle Mayo, San Clemente, Calif. 92672

[21] Appl. No.: 816,829

[22] Filed: Jan. 3, 1992

[51] Int. Cl.[5] ..... A47K 3/22; A47K 5/00

[52] U.S. Cl. ..... 4/605; 4/596

[58] Field of Search ..... 4/596, 597, 605, 610, 4/612, 614, 628; 206/77.1; 211/88; 312/242

[56] References Cited

U.S. PATENT DOCUMENTS

| | | | |
|---|---|---|---|
| 1,239,076 | 9/1917 | Baker | 312/242 |
| 1,267,353 | 5/1918 | Baker | 312/242 |
| 1,810,362 | 6/1931 | Lumley | 312/242 X |
| 2,577,011 | 12/1951 | Hallenscheid | 312/242 |
| 3,004,815 | 10/1961 | O'Kain et al. | 312/242 |
| 3,022,602 | 2/1962 | Turek et al. | 312/242 |
| 3,023,067 | 2/1962 | Maassen | 312/242 |
| 3,054,212 | 9/1962 | Morris | 312/351 |
| 3,323,850 | 6/1967 | Link | 312/242 |
| 3,620,404 | 11/1971 | Grasso | 312/242 X |
| 4,548,340 | 10/1985 | Messer | 222/135 |
| 4,577,751 | 3/1986 | St. Jacques | 206/77.1 |

*Primary Examiner*—William A. Cuchlinski, Jr.
*Assistant Examiner*—W. Morris Worth
*Attorney, Agent, or Firm*—Stetina and Brunda

[57] ABSTRACT

A shampoo box for holding toiletries within a shower enclosure has a watertight one-piece body which is disposed within a frame attached to the interior of a shower wall. The frame is formed to substantially surround the body such that it snugly receives and substantially supports the body. The frame may be attached to a vertical wall stud by nails or screws. The box is specifically sized to contain larger toiletry articles such as bottles of shampoo to provide convenient access thereto during showering. A method for installing the same is disclosed.

34 Claims, 2 Drawing Sheets

SHAMPOO BOX FOR SHOWER ENCLOSURE

FIELD OF THE INVENTION

The present invention relates generally to residential construction techniques and more particularly to a shampoo box for holding toiletries within a shower enclosure.

BACKGROUND OF THE INVENTION

Bathroom fixtures such as recessed soap holders for maintaining soap, wash clothes and the like at a convenient location within a shower enclosure are well known. One such device is disclosed in U.S. Pat. No. 1,267,353 issued to Baker on May 28, 1918 and entitled WALL RECEPTACLE. The Baker device comprises a soap dish of one-piece china construction having an optional wash cloth rod formed thereon. The Baker device is received by an aperture formed within the wall of the shower enclosure and is positioned substantially flush therewith.

Although such soap dishes are generally suitable for their intended purpose, i.e., the holding of soap and other such small toiletries, they possess inherent deficiencies which detract from their overall effectiveness. For example, it is frequently desired to maintain larger toiletries or articles within easy reach for use within the shower. Typical among these is shampoo and conditioner which are typically contained within bottles sized too large to be contained by such prior art devices. Thus, such shampoo and conditioner bottles are typically disposed upon the floor of the shower, outside of the shower, or at some other inconvenient location.

The inability to place shampoo and other larger articles within such prior art soap dishes necessitates that one using the shower must necessarily reach for such items in a manner which is inconvenient and often dangerous. For example, such articles disposed upon the floor of the shower or outside of the shower necessitate that one bend over and/or reach out of the shower to acquire these articles. This is often done when the individual is wet and the floor is wet and/or slippery. Thus, the placing of shampoo and such articles out of easy reach represents an unsafe situation which increases the likelihood of accidents such as slipping and/or falling which may result in serious injury.

Although the construction of larger receptacles is known, such larger receptacles suffer from other inherent deficiencies. For example, such larger recess receptacles are commonly constructed by forming a recess and shelf structure of complimentary construction to the remaining shower enclosure, i.e., either wallboard and tile or plaster, lath and tile. Such construction is inherently prone to water leakage because of the many corners or joints which must be sealed properly and maintained in good condition to avoid such leakage.

As such, although the prior art has recognized to a limited extent the problem of maintaining toiletries within easy reach within a shower enclosure, the proposed solutions have to date been ineffective in providing a satisfactory remedy.

SUMMARY OF THE INVENTION

The present invention specifically addresses and alleviates the above mentioned deficiencies associated in the prior art. More particularly, the present invention comprises a shampoo box for holding toiletries within a shower enclosure which has a watertight one-piece body which is disposed within a frame attached to the shower wall. The body defines a box having an opening only at the front through which toiletries are inserted and removed. Thus, the body is closed on all but one side thereof. The frame is formed to substantially surround the body such that it snugly receives and substantially supports the body. The frame may be attached to a vertical stud by nails or screws. The box is specifically sized to contain larger toiletry articles such as bottles of shampoo to provide convenient access thereto during showering. Shelves and/or a washcloth rod may optionally be provided.

These, as well as other advantages of the present invention will be more apparent from the following description and drawings. It is understood that changes in the specific structure shown and described may be made within the scope of the claims without departing from the invention.

DETAILED DESCRIPTION OF THE PREFERRED EMBODIMENT

The detailed description set forth below in connection with the appended drawings is intended as a description of the presently preferred embodiment of the invention, and is not intended to represent the only form in which the present invention may be constructed or utilized. The description sets forth the functions and sequence of steps for constructing and operating the invention in connection with the illustrated embodiments. It is to be understood, however, that the same or equivalent functions and sequences may be accomplished by different embodiments that are also intended to be encompassed within the spirit and scope of the invention.

Figure 1:
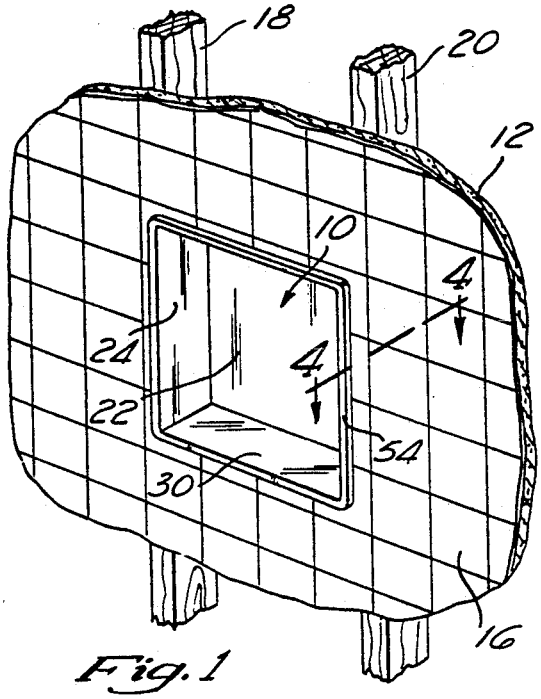
FIG. 1 is a perspective view of the shampoo box of the present invention installed within a shower enclosure wall.
Figure 3:
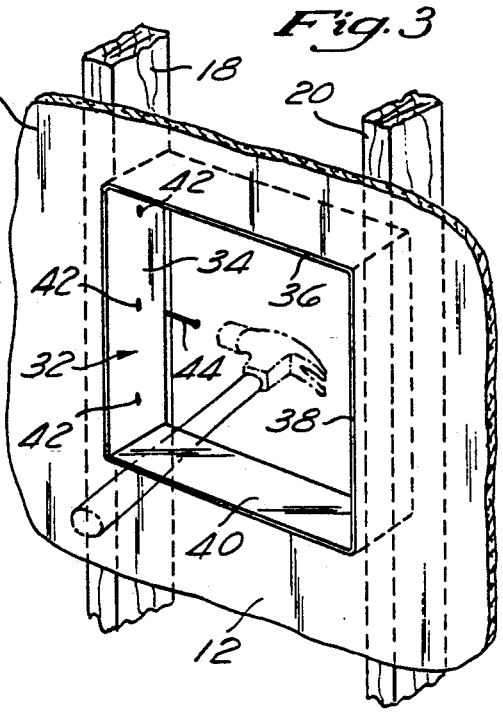
FIG. 3 is a perspective view of the frame and wall of FIG. 2 illustrating attachment of the frame to a vertical support member of the wall.
Figure 2:
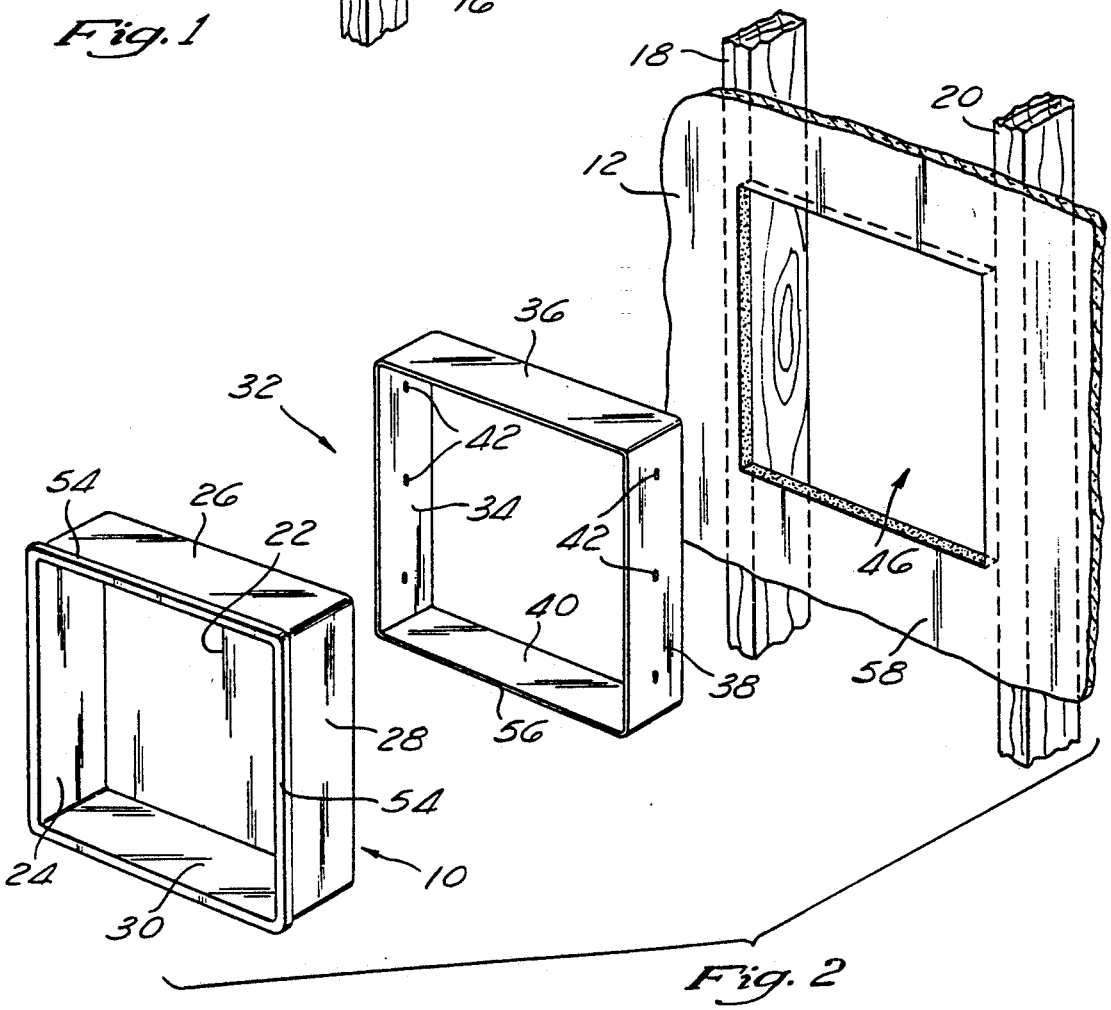
FIG. 2 is an exploded perspective view of the shampoo box and wall of FIG. 1 also showing the rectangular frame into which the shampoo box is disposed for mounting.

The shampoo box of the present invention is illustrated in FIGS. 1 through 6 which depict a presently preferred embodiment of the invention. Referring now to FIGS. 1–3, the shampoo box is comprised generally of a body 10 having a bottom 30, first and second sides 24 and 28, respectively, a top 26, a back 22, and a peripheral flange 54, all formed as an integral unit. Such one-piece construction eliminates the possibility of water leakage at the junctures of the various planar surfaces, i.e., the floor 30, first and second sides 24 and 28, respectively, the top 26 and the back 22. The body 10 is received through an opening 46 in the planar wall surface member or wall 12. The wall 12 is typically covered by tile or simulated tile 16. First 18 and second 20 studs or vertical members support the wall 12 as is typical in frame and wallboard construction.

The box in the preferred embodiment of the present invention is generally square and between 8 and 24 inches high and wide and between 3 and 6 inches deep, preferably approximately 16 inches high and wide and approximately 4 inches deep.

With particular reference to FIGS. 2 and 3, a frame 32 is attached to at least one of the studs 18 and/or 20. Attachment of the frame 32 to the studs 18 and/or 20 is accomplished by passing fasteners 44, such as nails or wood screws, through fastener apertures 42 formed within the frame and into the studs 18 and/or 20.

The aperture 46 formed within the wall 12 is sized at least large enough to receive the body 10 of the shampoo box and is preferably sized smaller than the outer periphery of the shampoo box body 10 such that the peripheral flange 54 will cover and obscure the opening 46. The opening 46 is preferably sufficiently large to receive the frame 32 to facilitate installation of the shampoo box in prior constructed shower enclosures. Those skilled in the art will recognize that in new construction applications, the frame 32 may be attached to the studs 18 and/or 20 prior to attaching the wall 12 to the studs 18 and/or 20, thus eliminating the requirement that the opening 46 be sized sufficiently large to receive the frame 32.

Optionally, the frame 32 may be constructed of a materially possessing sufficient flexibility to deform sufficiently to be passed through an opening 46 sized smaller than the frame 32. The opening 45 still being sized large enough to receive the body 10 of the shampoo box.

Figure 4:
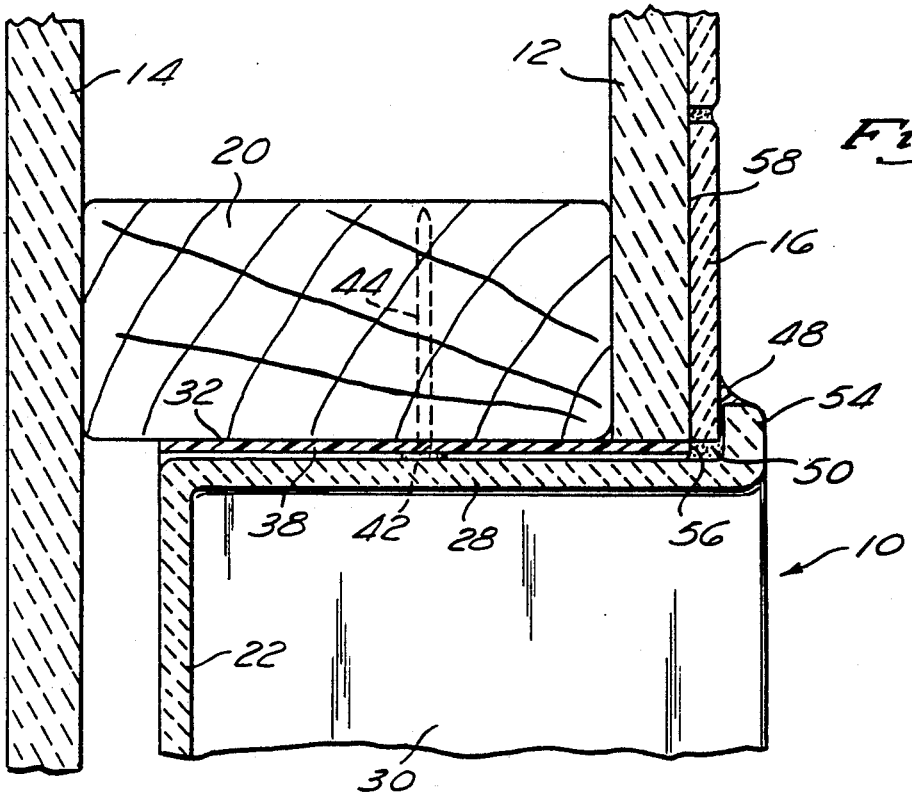
FIG. 4 is an enlarged cross-sectional view taken along lines 4 of FIG. 1 further illustrating attachment of the frame to a vertical support member of the wall and showing the shampoo box installed therein.
Figure 5:
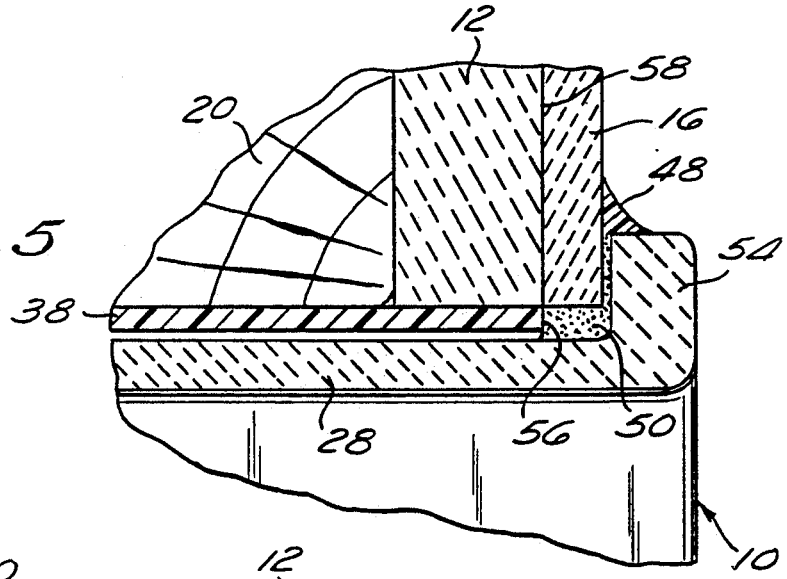
FIG. 5 is an enlarged cross-sectional view of a portion of the frame and shampoo box of FIG. 4 better showing the adhesive utilized to attach the shampoo box to the frame and wall and the caulk or grout utilized to seal the peripheral flange of the shampoo box to the tiled surface of the wall.

Referring now to FIGS. 4 and 5, attachment of the frame 32 to stud 20 via nail 44 is illustrated. Nail 44 has been hammered through fastener aperture 42 formed within side 38 of the frame 32 to securely attach the frame 32 to stud 20 such that frame 32 may be utilized to securely support shampoo box body 10 therein. As can be seen, shampoo box body 10 is disposed within frame 32 with the peripheral flange 54 thereof positioned substantially flush to the tile covering 16 of the wall 12. Adhesive, preferably DOW 5200 (a trademark of Dow Corning, Inc.) or a similar compound 50, attaches the body 10 to the frame 32 and the tile 16 and/or wall 12. A substantial quantity of adhesive 50 may be disposed intermediate the body 10 and the frame 32 to secure the body 10 within the frame 32. The adhesive 50 additionally seals the body 10 to the periphery of the opening 46 formed in the wall 12 to prevent water leakage therethrough. Grout or caulk 48 may likewise be applied about the outer periphery of the peripheral flange 54 to further seal against water leakage and to provide an aesthetically pleasing finish.

Figure 6:
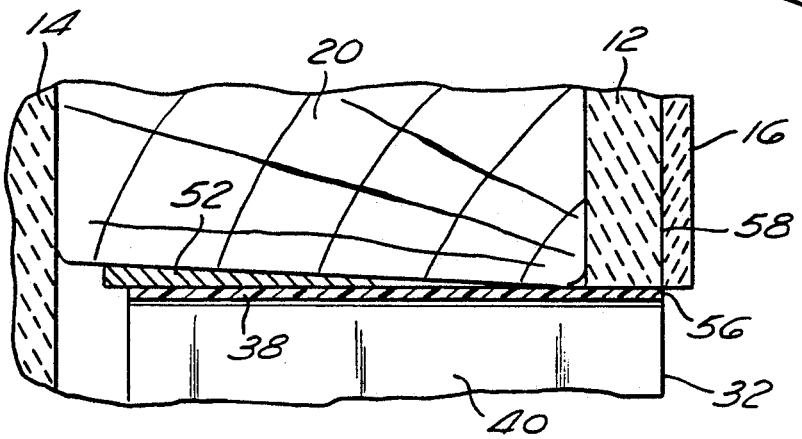
FIG. 6 is an enlarged cross-sectional view similar to that of FIG. 4 having the shampoo box removed from the frame and illustrating the use of a shim to maintain orthogonal alignment of the frame relative to the wall.

Referring now to FIG. 6, the use of a shim 52 to assure orthogonality of the finished installation is illustrated. Such shims may be utilized as required during attachment of the frame 32 to the studs 18 and 20 such that the frame 32, and consequently the body 10, will be plumb or orthogonal to the bathtub enclosure. Such shims typically comprise thin wedges or planar strips of wood, plastic or metal as is well known in the art. The shims 52 will typically be disposed intermediate the frame 32 and the studs 18 and/or 20 such that the bottom 40 and top 36 planar members of the frame 32 are level and substantially parallel to the floor of the bathroom.

The outer most surface 56 of the frame 32 is preferably positioned essentially flush to the outer surface 58 of the wall 12 and may function as a screed for the application of plaster or a similar finish.

Having described the structure of the shampoo box, it may be beneficial to describe the installation procedures for both initial construction and post construction applications. During initial construction, the frame 32 is attached to vertical studs 18 and/or 20 using fasteners such as nails or wood screws 44 which are passed through fastener apertures 42 of the frame 32. The frame 32 is shimmed and positioned as necessary to achieve plumb and orthogonal alignment thereof to facilitate a desired aesthetic appearance of the final construction.

An opening 46 is formed within the wall covering, typically sheet rock, prior to attachment of the wall 12 to the studs 18 and 20. The opening 46 is sized such that the forward or outermost edge 56 of the frame 32 is received thereby without excessive clearance. The frame 32 is preferably positioned such that the outermost edge 56 will be substantially flush to the outermost surface 58 of the wall covering 12.

After a tile, simulated tile, or similar desired surface 16 has been applied about the periphery of the opening 46, the body 10 of the shampoo box is inserted therethrough. Prior to full insertion of the body 10 through the opening 46 of the wall covering 12, adhesive 50 is applied to the outer surfaces of the bottom 30, sides 24 and 28, and top 26 to securely attach the body 10 to the frame 32. Care should be taken to assure that adequate adhesive is applied proximate the peripheral flange 54 of the body 10 to assure proper sealing against water leakage between the peripheral flange 54 and the wall 12 and/or frame 32. Grout or caulk 48 may be applied about the outer periphery of flange 54 as desired.

For post construction installation of the shampoo box, approximate location of the studs 18 and/or 20 is first achieved. This may be accomplished by methods well known in the art, i.e. use of electrical stud location means. A small aperture may then be formed within the wall covering 12 intermediate studs 18 and 20 through which precise positioning of the studs 18 and 20, may be determined. After determining the precise location of the studs 18 and 20, aperture 46 is formed such that at least one side thereof is proximate a stud 18 or 20. The aperture 46 is formed sufficiently large to receive frame 32. The frame 32 may optionally be formed of a sufficiently flexible material to permit it to be deformed sufficiently to be received by an opening 46 sized only sufficiently large to receive the body 10 such that the size of the required opening 46 is thereby minimized as discussed above.

The frame 32 is passed through the opening 46 and attached to at least one stud 18 and/or 20. The body 10 may then be positioned within the frame 32 and adhesive 50 used to secure the body 10 thereto as in new construction. Likewise, grout or caulk 48 may be applied about the periphery of the flange 54. Alternatively, the frame 32 may be omitted and the body 10 secured directly to the wall 12 and/or studs 18 and/or 20.

It is understood that the exemplary shampoo box described herein and shown in the drawings represents only a presently preferred embodiment of the invention. Indeed, various modifications and additions may be made to such embodiment without departing from the spirit and scope of the invention. For example, the shampoo box body and frame need not be generally rectangular, but rather may be of any desired shape and configuration. Furthermore, attachment of the frame to the vertical support members or studs may be by various means other than through the use of fasteners such as nails or wood screws. The use of various clamping and/or gripping arrangements are contemplated. Thus, these and other modifications may be obvious to those skilled in the art and may be implemented to adapt the present invention for use in a variety of different applications.

What is claimed is:

1. A shampoo box for holding toiletries within a shower enclosure, the shampoo box comprising:

a) a watertight one-piece body closed on all but one side thereof;

b) a frame substantially surrounding said body such that said body is snugly received and substantially supported thereby; and c) means for mounting said frame within a wall.

2. The shampoo box as recited in claim 1 wherein said body is formed in a generally rectangular configuration and said frame is formed in a complimentary, generally rectangular configuration.

3. The shampoo box as recited in claim 1 wherein said means for mounting said frame comprises fastener apertures formed therein such that fasteners may be used to attach said frame to vertical studs within the wall.

4. The shampoo box as recited in claim 1 wherein said body is comprised of a plastic material.

5. The shampoo box as recited in claim 1 wherein said body is comprised of a ceramic material.

6. The shampoo box as recited in claim 1 wherein said frame is of one-piece construction.

7. The shampoo box as recited in claim 6 wherein said frame is comprised of plastic.

8. A shower enclosure having a built-in shampoo box, the shower enclosure comprising:

a) a planar wall surface member;

b) at least one interior vertical support member to which said wall surface member is attached;

c) an aperture formed in said wall surface member adjacent said vertical support member;

d) a frame attached to said vertical support member, said frame generally conforming in size and shape to said aperture; and e) a one-piece shampoo box body substantially closed on all but one side thereof such that an opening is defined therein, said body received by said aperture and said frame such that the opening thereof is outwardly disposed.

9. The shower enclosure as recited in claim 8 wherein said shampoo box body is formed in a generally rectangular configuration and said frame is formed in a complimentary generally rectangular configuration.

10. The shower enclosure as recited in claim 8 wherein said frame comprises fastener apertures through which fasteners attach said frame to said vertical support member.

11. The shower enclosure as recited in claim 8 wherein said shampoo box body is comprised of a plastic material.

12. The shower enclosure as recited in claim 8 wherein the shampoo box body is comprised of a ceramic material.

13. The shower enclosure as recited in claim 8 wherein said frame is of one-piece construction.

14. The shower enclosure as recited in claim 13 wherein said frame is comprised of plastic.

15. A method for installing a shampoo box within a shower enclosure, the method comprising the steps of:

a) forming an aperture within a bath enclosure wall surface;

b) attaching a frame to a vertical support member of the wall;

c) positioning a shampoo box body within the frame such that the frame substantially supports the body; and d) bonding the shampoo box body into the frame.

16. The method as recited in claim 15 further comprising the step of applying a bead of caulk about the outer periphery of the body.

17. A method for constructing a shower enclosure having a built-in shampoo box, the method comprising the steps of:

a) attaching a frame having an opening formed therein to a vertical support member;

b) applying a planar wall surface over said frame and vertical support member, said wall surface having an opening formed therein such that the opening in said frame and the opening in said wall surface are generally contiguous;

c) positioning a shampoo box body within the openings in said frame and wall surface such that the outer surface of said shampoo box body is substantially flush with said wall surface; and d) applying a bead of caulk about the periphery of the shampoo box body.

18. A shampoo box for holding toiletries within a shower enclosure, the shampoo box comprising:

a) a watertight one-piece body closed on all but one side thereof;

b) means for supporting said body; and c) means for mounting said supporting means within a wall.

19. The shampoo box as recited in claim 18 wherein said body is formed in a generally rectangular configuration and said support means is formed in a complimentary, generally rectangular configuration.

20. The shampoo box as recited in claim 18 wherein said means for mounting said support means comprises fastener apertures formed therein such that fasteners may be used to attach said support means to vertical studs within the wall.

21. The shampoo box as recited in claim 18 wherein said body is comprised of a plastic material.

22. The shampoo box as recited in claim 18 wherein said body is comprised of a ceramic material.

23. The shampoo box as recited in claim 18 wherein said support means is of one-piece construction.

24. The shampoo box as recited in claim 23 wherein said support means is comprised of plastic.

25. A shower enclosure having a built-in shampoo box, the shower enclosure comprising:

a) a planar wall surface member;

b) at least one interior vertical support member to which said wall surface member is attached;

c) an aperture formed in said wall surface member adjacent said vertical support member;

d) a support means attached to said vertical support member, said support means generally conforming in size and shape to said aperture; and e) a one-piece shampoo box body substantially closed on all but one side thereof such that an opening is defined therein, said body received by said aperture and said support means such that the opening thereof is outwardly disposed.

26. The shower enclosure as recited in claim 25 wherein said shampoo box body is formed in generally rectangular configuration and said support means is formed in a complimentary generally rectangular configuration.

27. The shower enclosure a recited in claim 25 wherein said support means comprises fastener apertures through which fasteners attach said support means to said vertical support member.

28. The shower enclosure as recited in claim 25 wherein said shampoo box body is comprised of a plastic material.

29. The shower enclosure as recited in claim 25 wherein the shampoo box body is comprised of a ceramic material.

30. The shower enclosure as recited in claim 25 wherein said support means is of one-piece construction.

31. The shower enclosure as recited in claim 30 wherein said support means is comprised of plastic.

32. A method for installing a shampoo box within a shower enclosure, the method comprising the steps of:

a) forming an aperture within a bath enclosure wall surface;

b) attaching a support means to a vertical support member of the wall;

c) positioning a shampoo box body within the support means such that the support means substantially support the body; and d) bonding the shampoo box body into the support means.

33. The method as recited in claim 32 further comprising the step of applying a bead of caulk about the outer periphery of the body.

34. A method for constructing a shower enclosure having a built-in shampoo box, the method comprising the steps of:

a) attaching a support means having an opening formed therein to a vertical support member;

b) applying a planar wall surface over said support means and vertical support member, said wall surface having an opening formed therein such that the opening in said support means and the opening in said wall surface are generally contiguous;

c) positioning a shampoo box body within the openings in said support means and wall surface such that the outer surface of said shampoo box body is substantially flush with said wall surface; and d) applying a bead of caulk about the periphery of the shampoo box body.

* * * * *